US006530707B1

(12) United States Patent
Byrne et al.

(10) Patent No.: US 6,530,707 B1
(45) Date of Patent: Mar. 11, 2003

(54) BACK LOTION APPLICATOR

(76) Inventors: Dianne Marie Byrne, 32 Clarence Street, Brampton, Ontario (CA), L6W 1S3; Peter Graham Byrne, 32 Clarence Street, Brampton, Ontario (CA), L6W 1S3

( * ) Notice: Subject to any disclaimer, the term of this patent is extended or adjusted under 35 U.S.C. 154(b) by 0 days.

(21) Appl. No.: 09/953,171

(22) Filed: Sep. 17, 2001

(51) Int. Cl.[7] ..... A46B 5/02

(52) U.S. Cl. ..... 401/6; 401/176; 401/179; 401/181

(58) Field of Search ..... 401/6, 176, 179, 401/181, 177, 171, 172, 174

(56) References Cited

U.S. PATENT DOCUMENTS

| | | | | |
|---|---|---|---|---|
| 2,043,145 A | | 6/1936 | Bacher | |
| 2,250,878 A | | 7/1941 | Quaranti | |
| 2,452,006 A | | 10/1948 | Werner | |
| 2,800,673 A | | 7/1957 | Lazisky | |
| 2,864,108 A | | 12/1958 | Johnson | |
| 4,483,636 A | | 11/1984 | Meyer | |
| 4,615,066 A | | 10/1986 | Colognori | |
| 4,906,118 A | | 3/1990 | Crooks | |
| 5,211,494 A | | 5/1993 | Baiinath | |
| 5,277,511 A | | 1/1994 | Stockton | |
| 5,346,107 A | | 9/1994 | Bouix et al. | |
| 5,659,916 A | | 8/1997 | Beatty et al. | |
| 5,671,497 A | * | 9/1997 | Abdo | 15/144.1 |
| 5,851,077 A | * | 12/1998 | Trejo | 401/6 |
| 5,988,923 A | | 11/1999 | Arai | |
| 6,030,138 A | | 2/2000 | Losier | |
| 6,042,286 A | * | 3/2000 | Pazienza | 401/6 |
| 6,045,279 A | * | 4/2000 | Follis | 401/6 |
| 6,132,126 A | * | 10/2000 | Sheffler et al. | 401/213 |
| 6,190,073 B1 | * | 2/2001 | Kabigting | 401/6 |
| 6,261,014 B1 | * | 7/2001 | Altobellis et al. | 401/6 |

* cited by examiner

*Primary Examiner*—David J. Walczak
(74) *Attorney, Agent, or Firm*—Eugene J.A. Gierczak

(57) ABSTRACT

An applicator for dispensing a substance upon a body comprising a hollow member; a reservoir for said substance presented at one end of said hollow member; a piston disposed within said hollow member for communicating with said reservoir for dispensing said substance from said reservoir to said body; structure presented at another end of said hollow member for activating said piston.

7 Claims, 3 Drawing Sheets

BACK LOTION APPLICATOR

FIELD OF INVENTION

This invention relates generally to applicators for dispensing a substance upon a body and in particular relates to an applicator for dispensing lotion to remote portions of the human body and the method accomplishing same.

BACKGROUND ART

It is not uncommon for individuals to apply lotions, powders or other materials or substances to their backs or other remote portions of the human body, which are difficult to access. The application of such substances to the remote regions of the body is generally awkward and difficult. Such a problem may become more acute for the elderly and handicapped individuals.

Accordingly various devices and methods have heretofore been implemented in the prior art to accomplish the task of applying lotions, liquid soaps, powders or the like to remote portions of the human body.

For example U.S. Pat. No. 4,483,636 relates to a long-handled applicator device suitable for the application of oil, liquid soap and other similar materials on parts of the human body and includes a deformable elongate tubular member, an end cap detachably mounted to said tubular member and a hollow deformable dispensing head.

Moreover U.S. Pat. No. 5,659,916 illustrates applicators for applying body lotions where the handle comprises a curved elongated shaft having a gripping portion integral to one end and a pivotable mounting portion for mounting an applicator pad to an opposite end.

Moreover U.S. Pat. No. 2,800,673 relates to an applicator for powders and liquid having a tubular handle with a central hollow passageway, an air bulb mounted at one end of the handle and adapted to force air through the passageway, an applicator head mounted on the opposite end of the handle, where the applicator head comprises a powder containing cup-shaped housing having a backwall and an integrally formed annular sidewall.

Another arrangement is shown in U.S. Pat. No. 5,277,511 which illustrates an adhesive spreading or trawling device having a body provided with multi-notch elongated application edge, a plenum on the body adapted to receive and contain adhesive material under pressure.

Finally U.S. Pat. No. 5,887,310 relates to a back scrubbing brush with removable cover.

These and other structures and devices present relatively complicated structures.

It is an object of this invention to provide an improved applicator for dispensing a substance such as lotion or the like to remote portions of the human body.

DISCLOSURE OF INVENTION

It is an aspect of the invention to provide an applicator for dispensing a substance upon a body comprising a hollow member; a reservoir for said substance presented at one end of said hollow member; piston means disposed within said hollow member for communicating with said reservoir for dispensing said substance from said reservoir to said body; means presented at another end of said hollow member for activating said piston means.

It is a further aspect of this invention to provide an applicator for dispensing lotion to remote portions of the human body comprising a flexible hollow tubular member extending along an axial length thereof; a cup-shaped reservoir extending outwardly from one end of said tubular member and communicating therewith; a flexible shaft extending from said reservoir and one end of said tubular member to another end of said tubular member; a piston disposed within said reservoir and connected to said shaft at said one of said hollow tubular member; said reservoir adapted to receive said lotion upon said piston; an end cap engageable with said reservoir, said end cap including holes for dispensing said lotion; a handle presented by said tubular member at said other end; said handle presenting means for displacing said shaft and said piston so as to dispense lotion from said reservoir through said holes to remote portions of said body.

It is a further aspect of the invention to provide a method of applying lotion to a remote area of the human body with an applicator having a flexible hollow member with a reservoir containing said lotion at one end of said hollow member, piston means disposed within said hollow member, and means presented at another end of said hollow member for activating said piston means, comprising the steps of introducing lotion to said reservoir; bending said hollow member to a desired position so as to present said reservoir at a desired position relative said member so as to access said remote area of said human body; placing said reservoir adjacent said remote area of said human body; activating said piston means so as to dispense lotion from said reservoir to said human body.

BEST MODE FOR CARRYING OUT THE INVENTION

Figure 1:
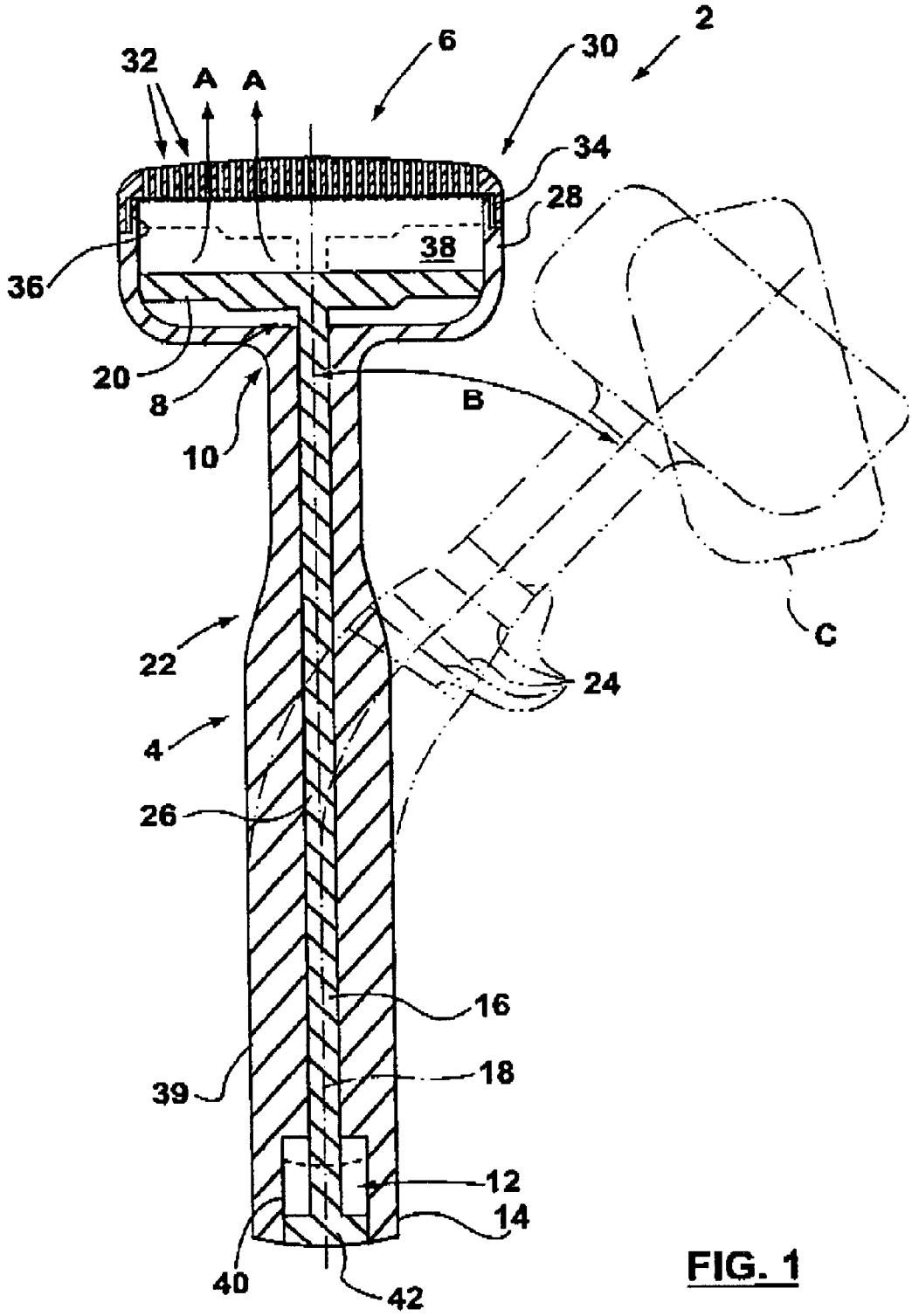
FIG. 1 is a representative view of the applicator.

In the description that follows, like parts are marked throughout the specification and the drawings with the same respective reference numerals. The drawings are not necessarily to scale and in some instances proportions may have been exaggerated in order to more clearly depict certain features of the invention.

FIG. 1 is a representative of the applicator 2.

The applicator 2 comprises generally a hollow member 4, a reservoir 6, and piston means 8. In particular the reservoir 6 is adapted to receive a substance such as lotion or the like in a manner to be more fully described herein. Moreover the reservoir 6 is presented at one end 10 of the hollow member 4.

Generally speaking the piston means 8 is disposed within the hollow member 4 and the piston means 8 communicates with the reservoir 6 for dispensing the substance such as lotion or the like from the reservoir 6 to the body of a user.

Means 12 are presented at another end 14 of the hollow member 4 for activating the piston means 8 in a manner to be more fully described herein. In particular the piston means 8 comprises a shaft 16 disposed within the hollow member 4 along an axial length thereof as for example defined by the axis 18. A piston 20 connected to the shaft 16 is disclosed in the drawings and the piston 20 is disposed within the reservoir 6.

Figure 2:
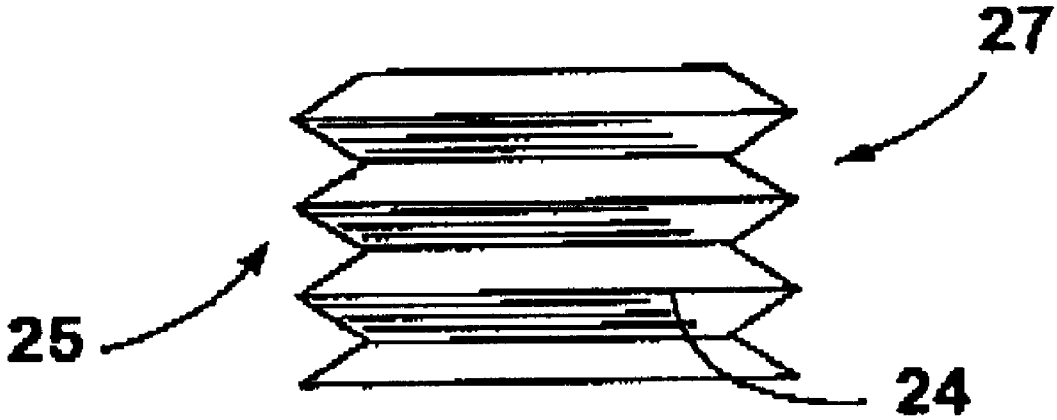
FIG. 2 is a representative view of the bending action of one embodiment of the applicator.
Figure 2:
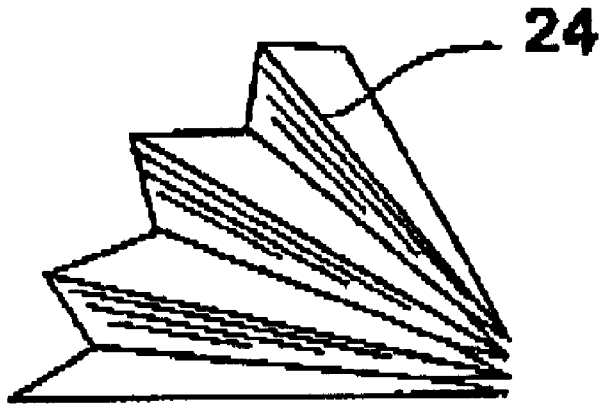

The hollow member 4 is flexible in the vicinity 22 of the reservoir 6 as shown. Furthermore the shaft 16 is also flexible in the vicinity 22 of the reservoir 6. More particularly the flexibility in the hollow member 4 is accomplished by including foldable surfaces 24 as shown which is similar to an accordian or bellowed structure as more fully particularized in FIG. 2. The foldable surface 24 as well as the material can be selected to provide any selected degree of flexibility. In one example, the hollow member can bend from the straight vertical position shown in FIG. 1 to a bent portion of up to 150° from the vertical shown in FIG. 1. In this the folded surfaces at 26 are expandable while the folded surfaces at 27 are foldable or contractible. Furthermore the hollow member 4 may be comprised of a flexible plastic having the foldable surfaces 24 as shown. Alternatively the flexibility in the hollow structure 4 may be accomplished by utilizing others materials such as rubber that bends or the like. Moreover the shaft 16 is also comprised of flexible material permitting the shaft to bend at the location 26 as shown in the drawings. Manufacturing the shaft from a suitable flexible material such as plastic, rubber or the like can comprise such flexibility.

As shown in the drawings one embodiment of the invention illustrates that the reservoir 6 is comprised of an applicator head 28 which can be an extension of the flexible handle 4 at one end 10. In particular the applicator head 28 extends outwardly from the one end 10 of the tubular member 4. Moreover the reservoir also includes an end cap 30 which is engageable with the applicator head 28. The end cap 30 includes holes 32 for dispensing a substance such as lotion or the like. In particular the applicator head 28 includes at its extremities an external thread 34. The end cap 30 includes internal threads 36 which are threadably engageable with the external threads 34 of the applicator head 28. In this way the end cap 30 may be threadably removed from the applicator head 28 so as to permit the introduction of lotion or the like into the cavity 38 defined by the applicator head 28 and above the piston 20. The lotion introduced into the cavity 38 is placed on top of the piston 20.

The reservoir 6 and in particular the applicator head 28 and end cap 30 may be of any desired shaped but in the embodiment shown in FIG. 1 are round in cross section. As described earlier the applicator head 28 is adapted to receive the piston 20 and the lotion.

The other end 14 of the flexible hollow member 4 includes a handle 39 and activating means 12 for activating the shaft 16 and piston 20. In particular the activating means 12 may comprise of a recess 40 presented at the end 14 of the member 4. The activation means may also include a plunger 42 connected to the shaft 16. In use an individual could activate the piston 20 by pushing the plunger and thus the shaft 16 towards the reservoir 6 so as to displace the shaft 16 and piston 20 towards the holes 32 of the reservoir 6 thereby displacing the lotion disposed within the cavity 38 through the holes 32 as illustrated by arrows A. Accordingly the applicator 2 illustrated in FIG. 1 can be used to dispense lotion contained in the cavity 38 to remote portions of the human body. In particular the applicator 2 comprises a flexible hollow tubular member 4 which extends along an axial length thereof as shown. Cup-shaped reservoir 6 extends outwardly from one end 10 of the tubular member 4. The cup-shaped reservoir 6 communicates with the tubular member 4 as shown.

As the plunger 42 is displaced from its rest position as shown in FIG. 1 the plunger 42 may be moved within the recess 40 to the furthermost depressed position illustrated by the hidden lines of 42 where the piston 20 will be moved to a furthermost position illustrated by the hidden lines as shown in the drawings.

Figure 3:
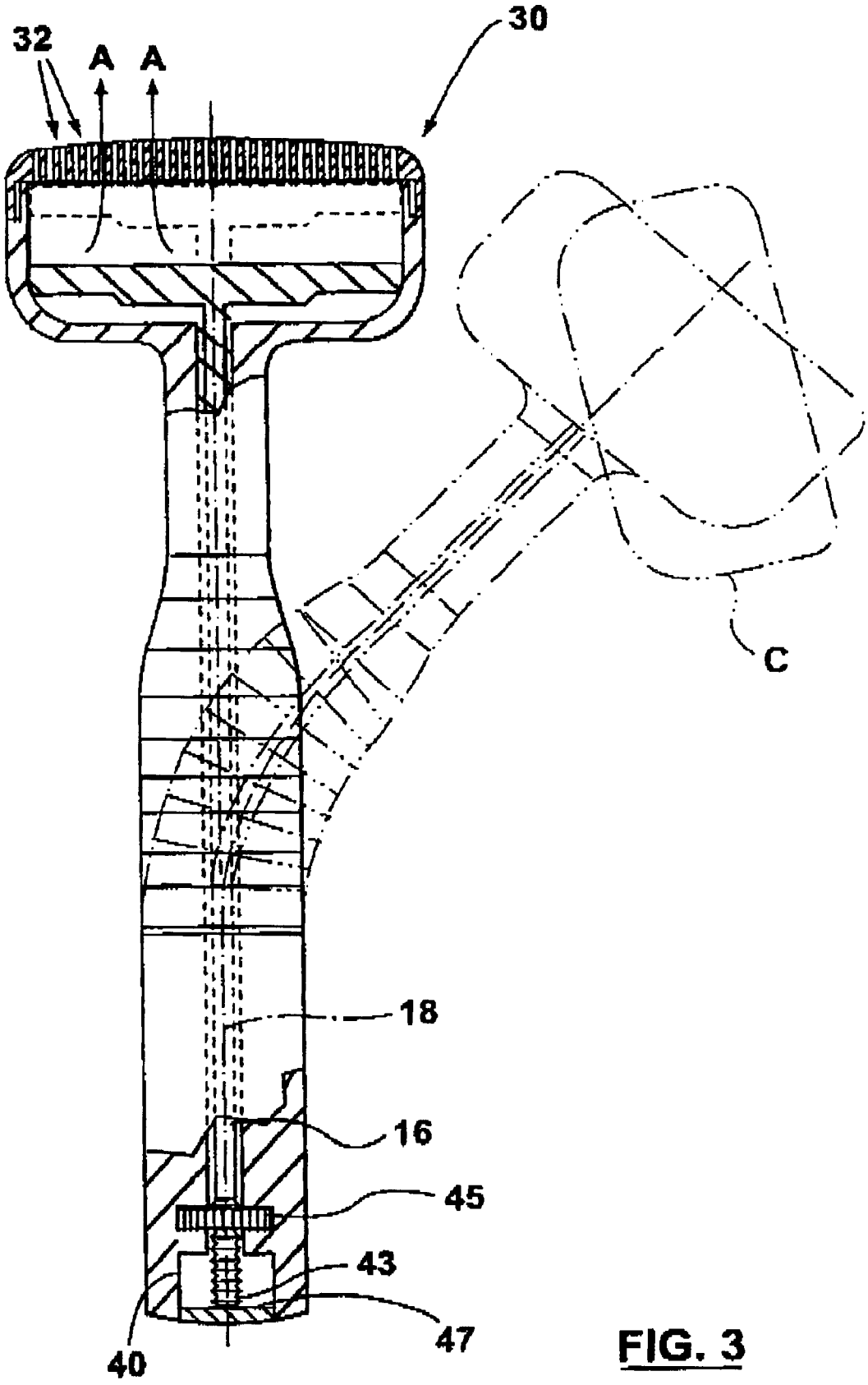
FIG. 3 is a representative view of another embodiment of the applicator.

An alternate activating means is shown in FIG. 3 where a recess 40 is presented at one end of the applicator 2 and one end of the shaft 16 is threaded at 43 and adapted to receive a rotatable wheel 45. The rotatable wheel 45 is knurled and adapted to be turned by a users finger or thumb so as to push or pull the shaft 16 and the piston 20. The wheel 45 is slightly larger in size than the bottom of the handle so as to present a moveable surface displaced from the handle. The bottom of the recess 40 includes a base 47 that can snap into position.

A flexible shaft 16 extends from the reservoir 6 at one end of the tubular member 10 to another end of the tubular member 14. A piston 20 is disposed in the reservoir 6 and is connected to the shaft 16 at one end 10 of the hollowed tubular member 4. The reservoir 6 is adapted to receive lotion upon the piston 20. An end cap 30 is engageable with the reservoir 6. The end cap 30 includes holes 32 for dispensing the lotion upon the remote areas of a human body. A handle 39 is presented by the tubular member 4 at the other end 14. Furthermore the handle 39 presents means for displacing the shaft 16 and the piston 20 so as to dispense the lotion from the reservoir 6 through the holes 32 to remote portions of the body.

The applicator 2 as illustrated in the drawings illustrates a shaft 16 and tubular member 4 which is manipulable so as to present the reservoir 6 at an acute angle B relative to the handle 39.

In production the tubular member 4 and applicator head 28 may be comprised of a single piece of flexible plastic, rubber or the like which can be manufactured in a variety of ways including extruding the part in a machine. Furthermore the end cap 30 may be manufactured in a variety of ways from plastic or the like. It is not necessary for the end cap 30 to be comprised of flexible plastic although it may be made of flexible plastic, hard plastic or the like. Although the embodiment shown in FIG. 1 illustrates that the end cap 30 may be threadably engageable with the applicator head 28 other embodiments can include an oval shaped end caps 30 which may be made from soft rubber that snaps on to the applicator head 28.

Furthermore the reservoir 6 may be pivotally manipulated relative to the axis 18 of the tubular member 4 as represented by C. In the embodiment shown the end cap 30 may be easily removed from the applicator head 28 so as to replenish the lotion placed within the cavity 38.

The invention described herein also teaches a method of applying lotion to remote areas of the human body by:

(a) introducing lotion into the reservoir 6 by removing the end cap 30 from the applicator head 28 and introducing the lotion into the cavity 38 on top of the piston 20. Thereafter the end cap is secured to the reservoir head.

(b) The user may then bend the hollow member 4 to a desired position so as to present the reservoir 6 at a desired position B relative to the hollow member 4 so as to access the desired remote area of the human body. The user may also bend the reservoirs 6 relative to axis 18 as shown by C.

(c) Activate the piston means 8 so as to dispense lotion from the reservoir 6 on to the human body.

Since the reservoir 6 may be manipulated so as to present the reservoir at any desired acute angle B relative to the handle 39 such device can be used by a large segment of the population.

Furthermore the device 2 may be sized so as to be useful to a large segment of the population. In one embodiment the device may extend 12 inches from one end 14 to the tip of the end cap 30 and present an end cap 4 inches in diameter. Furthermore the flexible handle may be one inch in diameter.

However, other sizes of applicator 2 may be utilized within the spirit of this invention.

Although the preferred embodiment as well as the operation and use have been specifically described in relation to the drawings, it should be understood that variations in the preferred embodiment could be achieved by a person skilled in the trade without departing from the spirit of the invention as claimed herein

What is claimed is:

1. An applicator for dispensing a substance upon body comprising:

(a) a hollow tubular member comprised of plastic wherein said hollow tubular member includes a foldable surface permitting said hollow tubular member to be flexible;

(b) an applicator head extending outwardly from one end of said hollow tubular member;

(c) an end cap which is threadably engageable with said applicator head, said end cap including holes for dispensing said substance;

(d) piston means disposed within said hollow tubular member for communicating with said applicator head for dispensing said substance from said applicator head to said body;

(e) said piston means comprises a flexible shaft disposed within said hollow tubular member and a piston connected to said flexible shaft, said piston disposed within said applicator head;

(f) means presented at another end of said hollow tubular member for activating said piston means;

(g) said applicator head is adapted to receive said piston and said substance.

2. An applicator as claimed in claim 1 wherein said activating means are presented at said other end of said hollow tubular member for:

(a) pushing said shaft through said hollow tubular member;

(b) pushing said piston within said applicator head so as to force said substance through said holes upon said body.

3. An applicator as claimed in claim 2 wherein said activating means comprises rotatable threaded means for pushing said shaft through said hollow tubular member.

4. An applicator for dispensing lotion to remote portions of the human body comprising:

(a) a flexible hollow tubular member extending along an axial length thereof;

(b) a cup-shaped reservoir extending outwardly from one end of said tubular member and communicating therewith;

(c) a flexible shaft extending from said reservoir and said one end of said tubular member to another end of said tubular member, (d) a piston disposed within said reservoir and connected to said shaft at said one end of said hollow tubular member;

(e) said reservoir adapted to receive said lotion upon said piston;

(f) an end cap engageable with said reservoir, said end cap including holes for dispensing said lotion and said end cap is removable so as to replace lotion within said reservoir;

(g) a handle presented by said tubular member at said other end;

(h) said handle presenting means for displacing said shaft and said piston so as to dispense lotion from said reservoir through said holes to remote portions of said body;

(i) wherein said shaft and tubular member are manipulable so as to present said reservoir and end cap at an acute angle relative to said handle.

5. An applicator as claimed in claim 4 wherein said shaft and tubular member are comprised of plastic.

6. An applicator as claimed in claim 5 wherein said reservoir is pivotable relative to said axis of said tubular member.

7. An applicator for dispensing lotion to remote portions of the human body comprising:

(a) a flexible hollow tubular member comprised of plastic extending along an axial length thereof;

(b) a cup-shaped reservoir extending outwardly from one end of said tubular member and communicating therewith;

(c) said reservoir is pivotable relative to said axis of said tubular member;

(d) a flexible shaft comprised of plastic extending from said reservoir and said one end of said tubular member to another end of said tubular member;

(e) a piston disposed within said reservoir and connected to said shaft at said one end of said hollow tubular member;

(f) said reservoir adapted to receive said lotion upon said piston;

(g) an end cap engageable with said reservoir, said end cap including holes for dispensing said lotion and said end cap is removable so as to replace lotion within said reservoir;

(h) a handle presented by said tubular member at said other end;

(i) said handle presenting means for displacing said shaft and said piston so as to dispense lotion from said reservoir through said holes to remote portions of said body;

(j) said shaft and said tubular member are manipulable so as to present said reservoir and end cap at an acute angle relative to said handle.

* * * * *